US006682242B1

(12) United States Patent
Montoli

(10) Patent No.: US 6,682,242 B1
(45) Date of Patent: Jan. 27, 2004

(54) DUAL COSMETIC APPLICATOR UNIT

(75) Inventor: Antonio Montoli, Brookfield, CT (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 10/266,902

(22) Filed: Oct. 8, 2002

(51) Int. Cl.[7] ..... B43K 27/02

(52) U.S. Cl. ..... 401/18; 401/17; 401/24; 401/25; 401/34; 401/126; 401/129

(58) Field of Search ..... 401/16–18, 24, 401/34, 126, 129, 130, 25; 215/228; 220/23.4, 23.6

(56) References Cited

U.S. PATENT DOCUMENTS

| | | | |
|---|---|---|---|
| 3,690,777 A | 9/1972 | Costa | 401/18 |
| 5,509,742 A | 4/1996 | Balzarini | 401/18 |
| 6,276,853 B1 | 8/2001 | Breidenback et al. | 401/18 |
| 6,612,764 B2 * | 9/2003 | Dumler et al. | 401/18 |
| 2002/0018688 A1 | 2/2002 | Dumler et al. | 401/18 |

* cited by examiner

*Primary Examiner*—Tuan N. Nguyen
(74) *Attorney, Agent, or Firm*—St. Onge Steward Johnston & Reens LLC

(57) ABSTRACT

A dual cosmetic applicator is formed from two applicator units, each of which includes a cap from which extends an applicator and an internally threaded sleeve facing the applicator. An enclosure includes an externally threaded end portion adapted to threadably engage the internally threaded sleeve of the cap. Each applicator unit also includes a coupling member which is formed by a central internal member surrounded by a peripheral wall, the peripheral wall having a plurality of projections laterally extending therefrom beyond the central internal member and a plurality of recesses corresponding in size, shape and number to the projections. An inner surface of the projections includes one half of a mating pair of snap fitting elements, while an outer surface of central internal member adjacent the recesses includes the other half of the mating pair of snap fitting elements.

33 Claims, 4 Drawing Sheets

DUAL COSMETIC APPLICATOR UNIT

FIELD OF THE INVENTION

The present invention relates to a cosmetic applicator unit, and more particularly to a cosmetic applicator unit wherein two different cosmetic applicators may be selected from a plurality of such cosmetic applicators and joined to form a dual cosmetic applicator unit.

BACKGROUND OF THE INVENTION

Mascara and similar cosmetic products are typically applied using a container and an accompanying brush or wand component. The brush component typically comprises a cap with an elongated shaft extending therefrom with an applicator surface at a distal end of the shaft. The cap threadedly engages the container allowing the device to be stored with the shaft and applicator surface received therein. When applying the cosmetic, a user dips the applicator portion into the tube to allow the cosmetic to adhere thereto.

Thus, known applicator devices have traditionally been formed as separate units—that is, a single container having a single threaded cap with a single applicator brush or wand extending therefrom. However, it was discovered that by combining two cosmetic applicator devices into a single unit a convenient and space-saving arrangement could be produced. U.S. Pat. No. 3,690,777 to Costa ("the '777 patent") discloses such a unit. More specifically, the applicator assembly disclosed in the '777 patent comprises a central cylindrical member which at each end is formed with internally threaded sleeves meeting at a solid area from which integrally project oppositely directed rods, one of the rods carrying an eyeliner brush and the other carrying a mascara applicator. The assembly also includes two cover members or reservoirs, each of which includes an externally threaded end portion which engages the internally threaded sleeves of the central cylindrical member. Thus, the single threaded cap with a single applicator wand extending therefrom of the traditional design was simply modified such that the cap was threaded on two oppositely facing sides thereof, with an applicator wand extending from each of the two threaded ends.

While the assembly disclosed in the '777 patent provides advantages over traditional applicator designs, it still suffers from disadvantages of its own. One such disadvantage relates to the fact that the central cylindrical member of the device disclosed in the '777 patent is an integrally formed piece from which the two rods project. As such, the two cosmetic applicators are fixed and cannot readily be interchanged. This is a disadvantage because the user may wish to change the type of applicators which form the unit and/or change the color of the cosmetic which the unit carries. For example, the '777 patent discloses a unit which combines an eyeliner brush and a mascara applicator. However, the user may wish instead to combine a mascara applicator with a nail polish brush. In another example, suppose the user wished to use the same mascara, but desired to use a blue eyeliner rather than a black eyeliner originally being used. The unit disclosed in the '777 patent disadvantageously would not allow a user to modify the combination of the two applicators.

These disadvantages of the '777 patent were addressed in U.S. Published patent application Ser. No. 2002/0018688 A1 to Dumler et al. ("the '688 reference"), which discloses a cosmetic applicator unit that comprises two different applicators which are interconnectable together via a pair of coupling members.

In one embodiment of the '688 reference, the applicators are connected together by means of a locking projection on one coupling member which cooperates with a locking recess on the other coupling member. This embodiment, however, suffers from a number of disadvantages. First, it is undesirable from a manufacturing standpoint to have to manufacture two distinct coupling members. It would be less expensive and more convenient if the coupling members were identical to each other. Second, having two distinct coupling members may cause compatibility problems for the user. More specifically, a user will not be able to combine two applicators to form a unit if both applicators have like coupling members (i.e., applicators having coupling members with a locking projection cannot be combined with other applicators also having coupling members with a locking projection and applicators having coupling members with a locking recess cannot be combined with other applicators also having coupling members with a locking recess).

These disadvantages are not found in another embodiment of the '688 reference, wherein the applicators are connected together by means of coupling members, each having male threaded ends joined to each other by a female threaded coupling (see FIG. 7). This embodiment, however, disadvantageously requires the manufacture and sale of a separate piece (i.e., the female threaded coupling), which can increase the cost of manufacture and the complexity of assembly by the user.

What is desired, therefore, is a dual cosmetic applicator which allows for two different cosmetic applicators to be selected from a plurality of such cosmetic applicators and joined together, which is relatively simple to manufacture and use, which includes coupling sections which are identical to each other, and which allows for the coupling sections to directly engage each other without the need for a separate additional piece.

SUMMARY OF THE INVENTION

Accordingly, it is an object of the present invention to provide a dual cosmetic applicator which allows for two different cosmetic applicators to be selected from a plurality of such cosmetic applicators and joined together.

Another object of the present invention is to provide a dual cosmetic applicator having the above characteristics and which is relatively simple to manufacture and use.

A further object of the present invention is to provide a dual cosmetic applicator having the above characteristics and which includes coupling sections which are identical to each other.

Still another object of the present invention is to provide a dual cosmetic applicator having the above characteristics and which allows for the coupling sections to directly engage each other without the need for a separate additional piece.

These and other objects of the present invention are achieved by provision of a dual cosmetic applicator formed from two applicator units, each of which includes a cap from which extends an applicator and an internally threaded sleeve facing the applicator. An enclosure includes an externally threaded end portion adapted to threadably engage the internally threaded sleeve of the cap. Each applicator unit also includes a coupling member which is formed by a central internal member surrounded by a peripheral wall, the peripheral wall having a plurality of projections laterally extending therefrom beyond the central internal member and a plurality of recesses corresponding in size, shape and number to the projections. An inner surface of the projections includes one half of a mating pair of snap fitting elements, while an outer surface of central internal member adjacent the recesses includes the other half of the mating pair of snap fitting elements.

The mating pair of snap fitting elements preferably comprises a protuberance and a corresponding recess. The protuberance may extend radially outwardly from the outer surface of the central internal member with the cooperating recess formed in the inner surface of the projection, or the protuberance may extend radially inwardly from the inner surface of the projection with the cooperating recess formed in the outer surface of the central internal member.

Preferably, the coupling member is integrally formed as part of the cap. It is also preferable that the plurality of projections comprises two projections and the plurality of recesses comprises two recesses. The enclosure may comprise a reservoir which contains cosmetic to be applied. The coupling member may be substantially circular in cross-section, substantially square in cross-section, or any of numerous other shapes. The coupling members of the two applicator units are most preferably identical. It is also preferable that the peripheral wall of the coupling member be formed from a resilient elastically deformable material.

The invention and its particular features and advantages will become more apparent from the following detailed description considered with reference to the accompanying drawings.

DETAILED DESCRIPTION OF AN EMBODIMENT OF THE INVENTION

Figure 1:
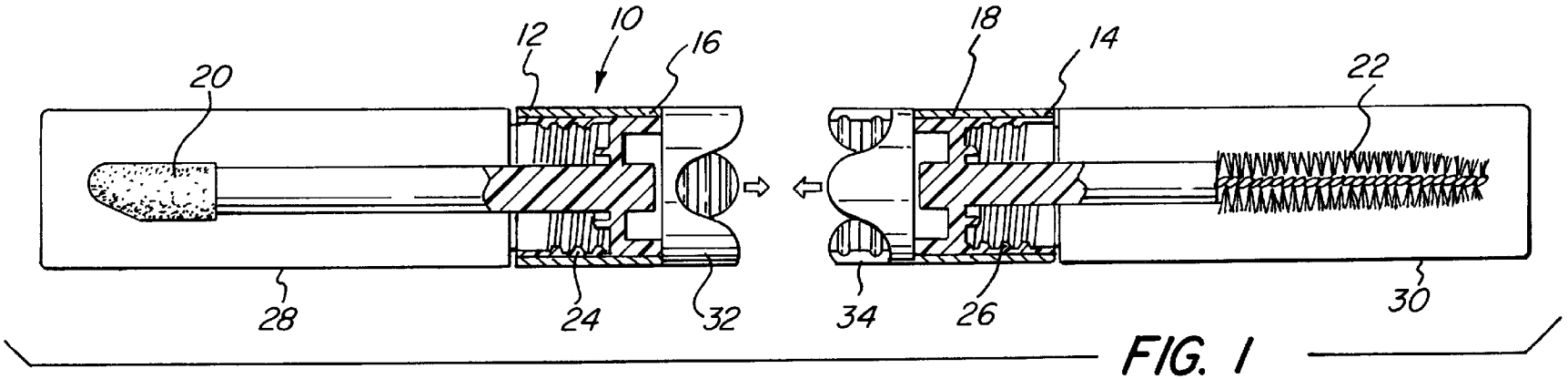
FIG. 1 is a partially cross-sectional side view of a dual cosmetic applicator in accordance with the present invention.
Figure 2:
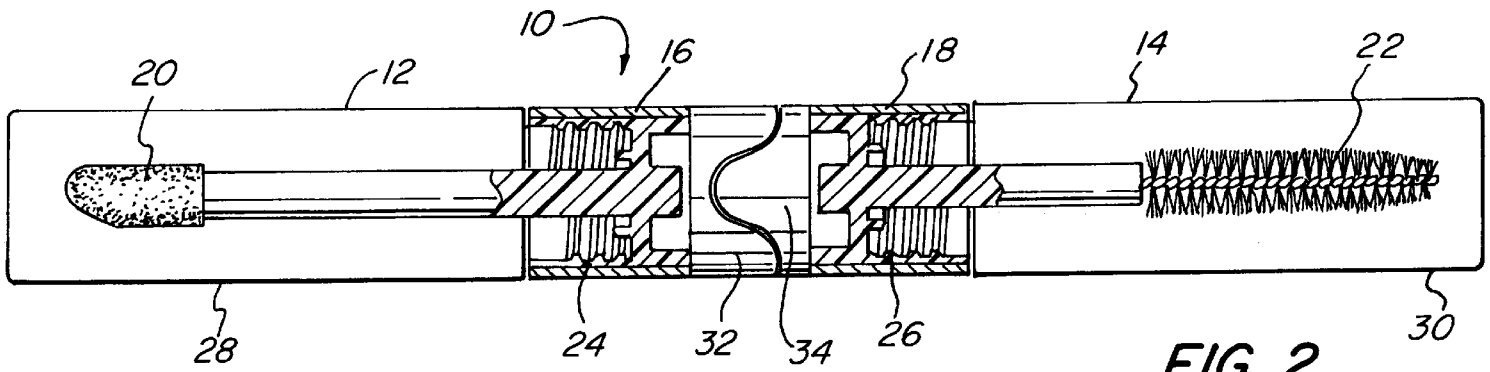
FIG. 2 is a partially cross-sectional side view of the dual cosmetic applicator of FIG. 1 shown with the applicator units joined together.
Figure 3:
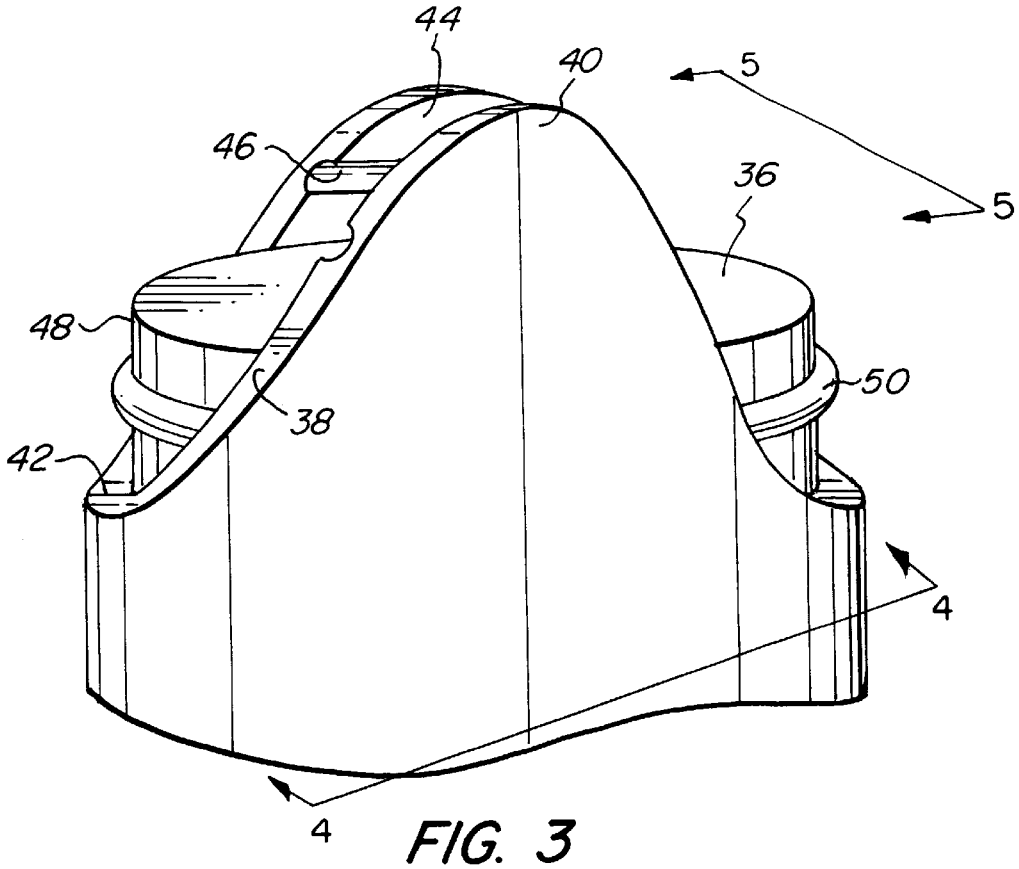
FIG. 3 is an enlarged perspective side view of the coupling section of one of the applicator units of the dual cosmetic applicator of FIG. 1.
Figure 4:
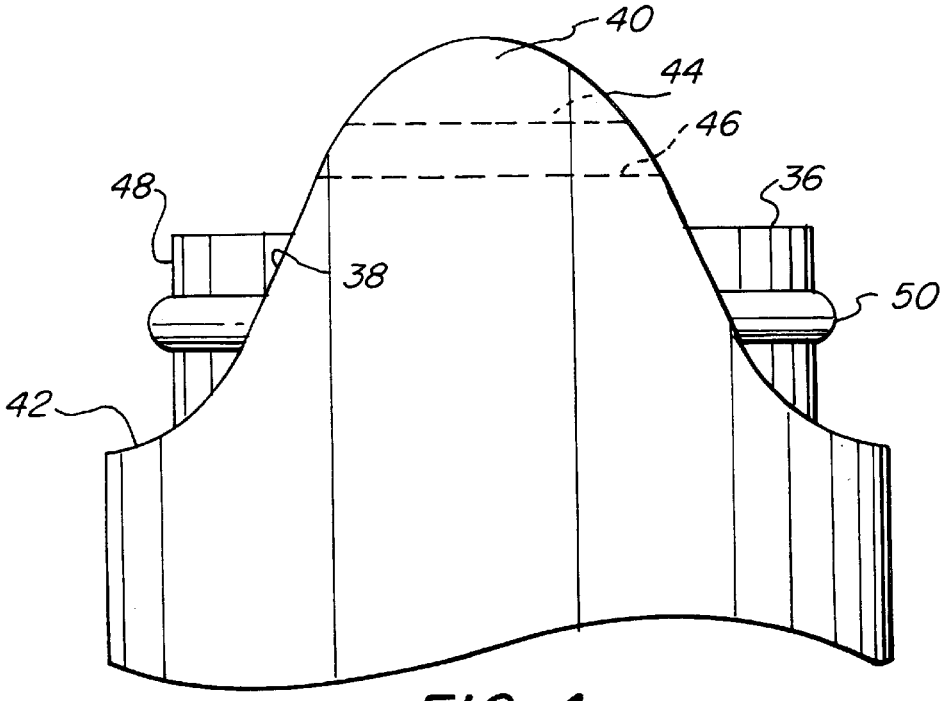
FIG. 4 is a partially cross-sectional view of the coupling section of one of the applicator units of the dual cosmetic applicator taken along line 4—4 of FIG. 3.
Figure 5:
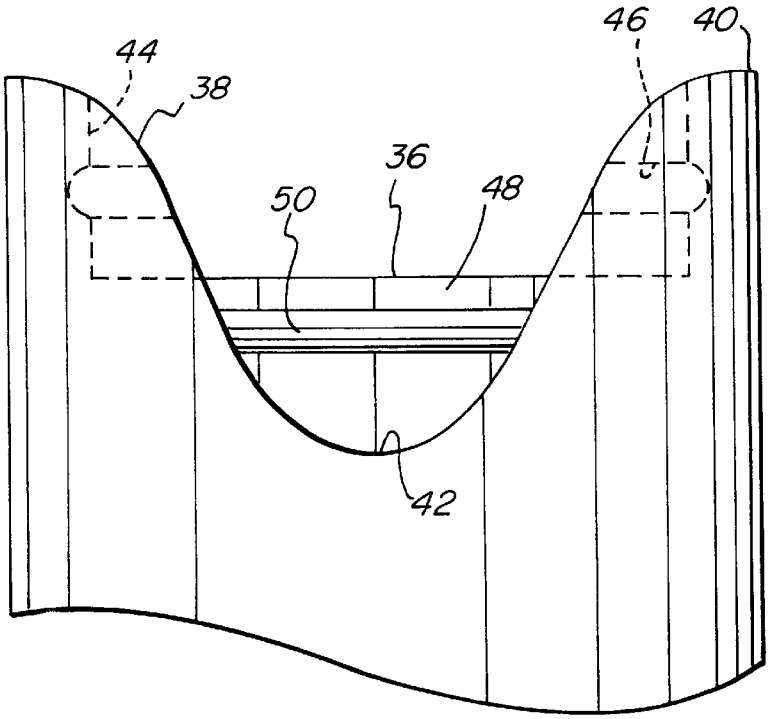
FIG. 5 is a partially cross-sectional view of the coupling section of one of the applicator units of the dual cosmetic applicator taken along line 5—5 of FIG. 3.
Figure 6:
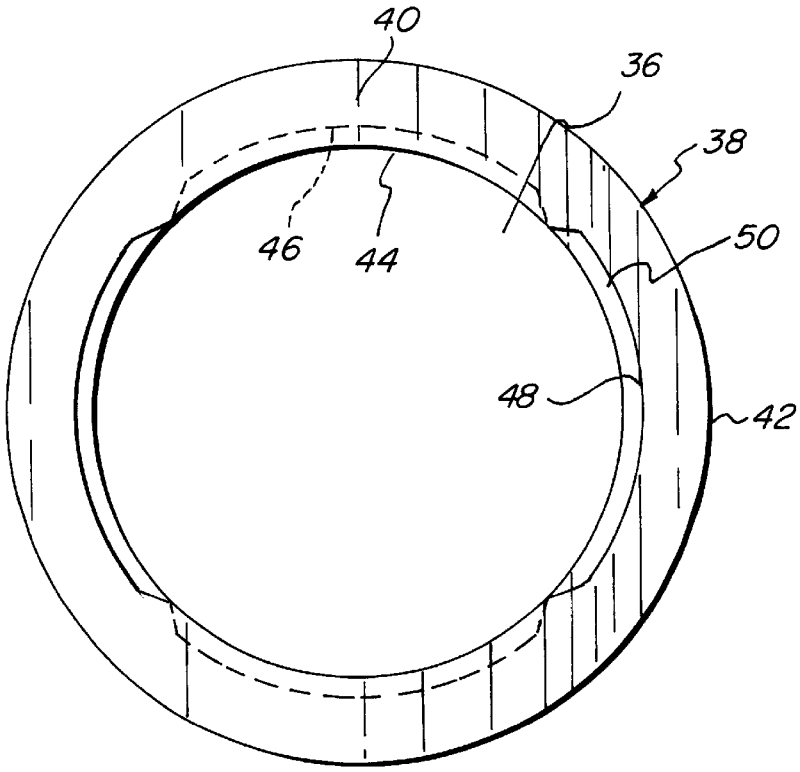
FIG. 6 is an enlarged partially cross-sectional end view of the coupling section of one of the applicator units of the dual cosmetic applicator of FIG. 1.

Referring first to FIGS. 1 and 2, a dual cosmetic applicator unit 10 in accordance with the present invention is shown. Dual cosmetic applicator unit 10 is comprised of a first applicator unit 12 and a second applicator unit 14, each of which includes a cap 16, 18 from which extends an applicator. In the embodiment shown, the applicator of first applicator unit 12 comprises a lip gloss applicator 20 while the applicator of second applicator unit 14 comprises a mascara brush 22. It should be understood, however, that it is contemplated that numerous other types of applicators, such as nail polish, eyeliner, lipsticks, etc. may also be used. Applicators 20, 22 may be fixed to caps 16, 18 in any suitable manner. Each of caps 16, 18 includes, on its end facing its respective applicator 20, 22, an internally threaded sleeve 24, 26 which is sized to threadably engage an exterior thread on a cooperating enclosure 28, 30. Enclosure may simply protect applicator 20, 22 or may comprise a reservoir which contains the cosmetic to be applied. In the above-described ways, each of applicator units 12,14 is similar to traditional cosmetic applicator units.

However, the present invention radically differs from traditional applicator units in that each of caps 16, 18 includes a coupling section 32, 34 which conveniently allows applicator units 12, 14 to be quickly and easily joined together to form dual cosmetic applicator unit 10.

Referring now to FIGS. 3–6, coupling sections 32, 34 are shown in more detail. It should be noted that coupling sections 32, 34 are identical and therefore only one is shown in each of FIGS. 3–6. The provision of identical coupling sections has the advantage of being less expensive and more convenient to manufacture than if two distinct coupling members were required to be manufactured. Moreover, having identical coupling sections obviates any compatibility problems associated with having two complimentary coupling members, wherein a user is not able to combine two applicators to form a unit if both applicators have like coupling members.

Figure 7:
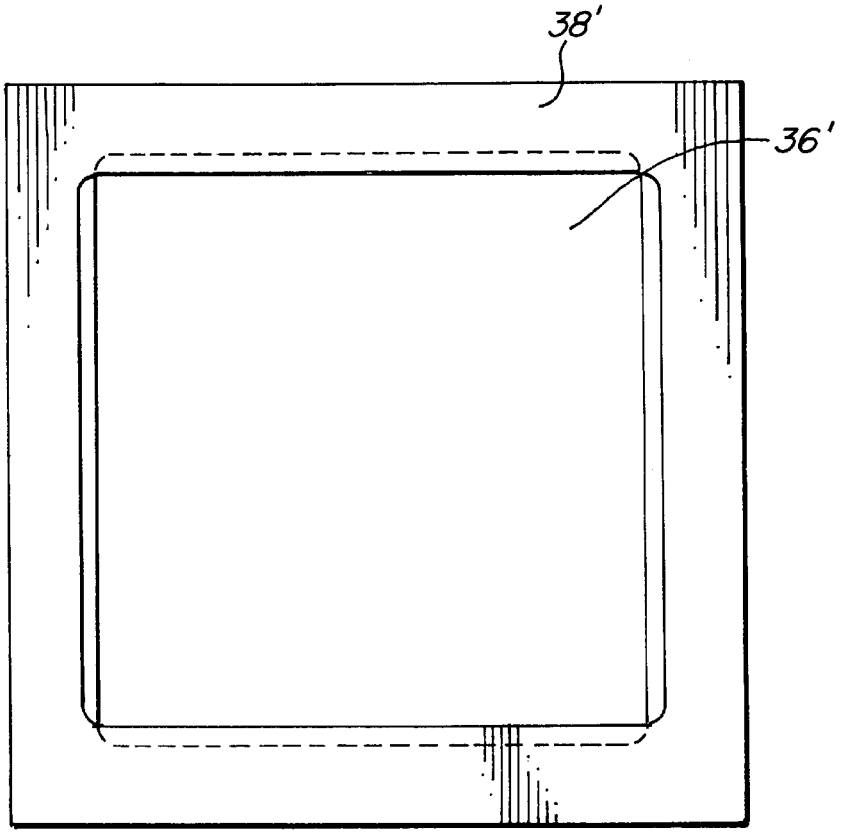
FIG. 7 is an enlarged partially cross-sectional end view of the coupling section of one of the applicator units of a dual cosmetic applicator in accordance with another embodiment of the present invention.
Figure 8:
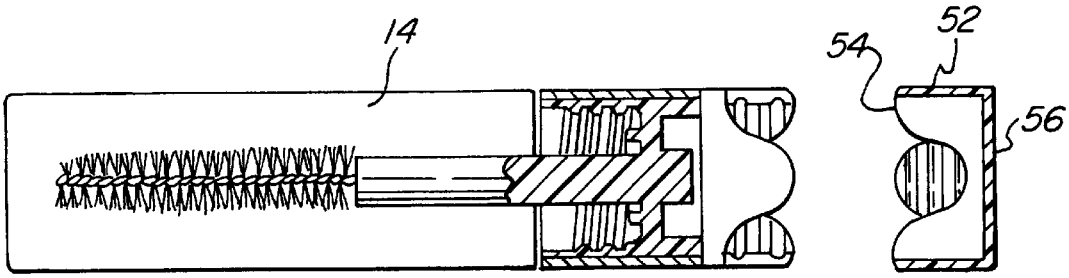
FIG. 8 is a partially cross-sectional side view of one of the applicator units of the dual cosmetic applicator of FIG. 1 shown in conjunction with a cap.

Each coupling section includes a central internal member 36 which is surrounded by a peripheral wall 38. Wall 38 is configured to have a plurality of projections 40 laterally extending therefrom beyond central internal member 36 and a corresponding number of recesses 42. Projections 40 and recesses 42 are sized, shaped and spaced such that two coupling members, when properly axially and rotationally aligned, may be brought together (indicated by arrows in FIG. 1) in order to snugly engage each other (as shown in FIG. 2). Projections 40 and recesses 42 may be rounded, such that wall 38 has an undulating configuration (as shown in FIGS. 3–6) or may have any other configuration (e.g., squared), so long as projections 40 on one coupling member can engage recesses 42 on an adjacent coupling member. Although two projections 40 and two recesses 42 are shown in FIGS. 3–7, it should be understood that a greater number of projections 40 and recesses 42 may be provided, as shown in FIGS. 1, 2 and 8 (which shows three projections 40 and three recesses 42).

The inner surface 44 of each projection 40 includes one half of a mating pair of snap fitting elements 46, while the outer surface 48 of central internal member 36 includes the other half of the mating pair of snap fitting elements 50 adjacent to recesses 42. In the embodiment shown in the FIGS., the mating pair of snap fitting elements 46, 50 takes the form of a protuberance extending radially outwardly from outer surface 48 of central internal member 36 and a cooperating recess formed in inner surface 44 of each projection 40. However, it should be understood that this scenario could just as easily be reversed, with the protuberance extending radially inwardly from inner surface 44 of each projection 40 and with the recess formed in outer surface 48 of central internal member 36.

In order to connect applicator units 12, 14 to one another in order to form dual applicator unit 10, applicator units 12, 14 are aligned along a common axis and are rotated with respect to one other such that projections 40 of applicator unit 12 align with recesses 42 in the other applicator unit 14 (as shown in FIG. 1). Applicator units 12, 14 are then pushed toward each other (indicated by arrows in FIG. 1) until the mating pair of snap fitting elements 46, 50 contact each other, at which point, projections 40 are forced to splay radially outwardly apart. Applicator units 12, 14 are pushed toward each other farther until snap fitting elements 46, 50 align with one another, at which point projections 40 snap back radially inwardly, thereby causing snap fitting elements 46, 50 t o engage one another and snugly secure applicator units 12, 14 to one another. Applicator units 12, 14 can be separated by reversing this process.

In order to accomplish the above-described snap-fit connection, wall 38 of each coupling member is formed from a material which allows for resilient elastic deformation of projections 40. Also, it should be noted that applicator units 12, 14, and therefore central internal member 36 and peripheral wall 38 may have a substantially circular cross-section (as shown in FIGS. 1–6), or may have any of numerous other configurations. FIG. 7 shows central internal member 36' and peripheral wall 38' having a substantially square cross-section. However, it should be understood that no matter the precise shape, coupling sections 32, 34 operate as described above with respect to FIGS. 1–6.

It should be obvious that applicator units 12, 14 incorporating coupling sections 32, 34 as described above can be directly connected to each other without the need for a separate additional connecting piece as is required by prior art designs.

Referring now to FIG. 8, it may be desirable to use one of applicator units 12, 14 on its own without having it connected to another applicator unit. However, it may be awkward and/or uncomfortable to use only a single applicator unit because the configuration of coupling sections 32, 34 may interfere with the handling of caps 16, 18. For this reason, a blind cap 52 may be provided. Blind cap 52 may simply consist of a coupling section 54 substantially identical to coupling sections 32, 34 described above and an end wall 56. With blind cap 52 installed, applicator units 12, 14 can be used in a similar manner as traditional single applicator units.

The present invention, therefore, provides a dual cosmetic applicator which allows for two different cosmetic applicators to be selected from a plurality of such cosmetic applicators and joined together, which is relatively simple to manufacture and use, which includes coupling sections which are identical to each other, and which allows for the coupling sections to directly engage each other without the need for a separate additional piece.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A dual cosmetic applicator formed from two applicator units, each of said applicator units comprising:

a cap from which extends an applicator, said cap having an internally threaded sleeve facing the applicator;

an enclosure having an externally threaded end portion adapted to threadably engage the internally threaded sleeve of said cap; and a coupling member, said coupling member comprising a central internal member surrounded by a peripheral wall, the peripheral wall having a plurality of projections laterally extending therefrom beyond the central internal member and a plurality of recesses corresponding in size, shape and number to the projections, an inner surface of the projections including one half of a mating pair of snap fitting elements, and an outer surface of central internal member adjacent the recesses including the other half of the mating pair of snap fitting elements.

2. The dual cosmetic applicator of claim 1 wherein the mating pair of snap fitting elements comprises a protuberance and a corresponding recess.

3. The dual cosmetic applicator of claim 2 wherein the mating pair of snap fitting elements comprises a protuberance extending radially outwardly from the outer surface of the central internal member and a cooperating recess formed in the inner surface of the projection.

4. The dual cosmetic applicator of claim 2 wherein the mating pair of snap fitting elements comprises a protuberance extending radially inwardly from the inner surface of the projection and a cooperating recess formed in the outer surface of the central internal member.

5. The dual cosmetic applicator of claim 1 wherein said coupling member is integrally formed as part of said cap.

6. The dual cosmetic applicator of claim 1 wherein the plurality of projections comprises two projections and wherein the plurality of recesses comprises two recesses.

7. The dual cosmetic applicator of claim 1 wherein said enclosure comprises a reservoir which contains cosmetic to be applied.

8. The dual cosmetic applicator of claim 1 wherein said coupling member is substantially circular in cross-section.

9. The dual cosmetic applicator of claim 1 wherein said coupling member is substantially square in cross-section.

10. The dual cosmetic applicator of claim 1 wherein said coupling members of the two applicator units are identical.

11. The dual cosmetic applicator of claim 1 wherein the peripheral wall of said coupling member is formed from a resilient elastically deformable material.

12. A cosmetic applicator comprising:

a cap from which extends an applicator, said cap having an internally threaded sleeve facing the applicator;

an enclosure having an externally thread ed end portion adapted to threadably engage the internally threaded sleeve of said cap; and a coupling member, said coupling member comprising a central internal member surrounded by a peripheral wall, the peripheral wall having a plurality of projections laterally extending therefrom beyond the central internal member and a plurality of recesses corresponding in size, shape and number to the projections, an inner surface of the projections including one half of a mating pair of snap fitting elements, and an outer surface of central internal member adjacent the recesses including the other half of the mating pair of snap fitting elements.

13. The cosmetic applicator of claim 12 wherein said coupling member of said cosmetic applicator is adapted to attach to a like coupling member of a second cosmetic applicator.

14. The cosmetic applicator of claim 12 further comprising a blind cap detachably connectable to said coupling member.

15. The cosmetic applicator of claim 12 wherein the mating pair of snap fitting elements comprises a protuberance and a corresponding recess.

16. The cosmetic applicator of claim 15 wherein the mating pair of snap fitting elements comprises a protuberance extending radially outwardly from the outer surface of the central internal member and a cooperating recess formed in the inner surface of the projection.

17. The cosmetic applicator of claim 15 wherein the mating pair of snap fitting elements comprises a protuberance extending radially inwardly from the inner surface of the projection and a cooperating recess formed in the outer surface of the central internal member.

18. The cosmetic applicator of claim 12 wherein said coupling member is integrally formed as part of said cap.

19. The cosmetic applicator of claim 12 wherein the plurality of projections comprises two projections and wherein the plurality of recesses comprises two recesses.

20. The cosmetic applicator of claim 12 wherein said enclosure comprises a reservoir which contains cosmetic to be applied.

21. The cosmetic applicator of claim 12 wherein said coupling member is substantially circular in cross-section.

22. The cosmetic applicator of claim 12 wherein said coupling member is substantially square in cross-section.

23. The cosmetic applicator of claim 12 wherein the peripheral wall of said coupling member is formed from a resilient elastically deformable material.

24. A cap for a cosmetic container, said cap comprising:

a central internal member surrounded by a peripheral wall;

a plurality of projections laterally extending from the peripheral wall beyond the central internal member, said projections including on an inner surface thereof one half of a mating pair of snap fitting elements;

a plurality of recesses in the peripheral wall corresponding in size, shape and number to the projections, and wherein an outer surface of said central internal member adjacent the recesses includes the other half of the mating pair of snap fitting elements.

25. The cap of claim 24 wherein said cap is adapted to attach to a second like cap.

26. The cap of claim 24 further comprising a blind cap detachably connectable to said cap.

27. The cap of claim 24 wherein the mating pair of snap fitting elements comprises a protuberance and a corresponding recess.

28. The cap of claim 27 wherein the mating pair of snap fitting elements comprises a protuberance extending radially outwardly from the outer surface of said central internal member and a cooperating recess formed in the inner surface of said projections.

29. The cap of claim 27 wherein the mating pair of snap fitting elements comprises a protuberance extending radially inwardly from the inner surface of said projections and a cooperating recess formed in the outer surface of said central internal member.

30. The cap of claim 24 wherein said plurality of projections comprises two projections and wherein the plurality of recesses comprises two recesses.

31. The cap of claim 24 wherein said cap is substantially circular in cross-section.

32. The cap of claim 24 wherein said cap is substantially square in cross-section.

33. The cap of claim 24 wherein the peripheral wall is formed from a resilient elastically deformable material.

* * * * *